US007694475B2

(12) United States Patent
Rae

(10) Patent No.: US 7,694,475 B2
(45) Date of Patent: Apr. 13, 2010

(54) FIRE RATED GLASS FLOORING

(75) Inventor: Michael Scott Rae, Saffron Walden (GB)

(73) Assignee: Wilde Contracts Limited, Oldham (GB)

( * ) Notice: Subject to any disclaimer, the term of this patent is extended or adjusted under 35 U.S.C. 154(b) by 1520 days.

(21) Appl. No.: 10/471,203

(22) PCT Filed: Mar. 11, 2002

(86) PCT No.: PCT/GB02/01113

§ 371 (c)(1),
(2), (4) Date: Feb. 24, 2004

(87) PCT Pub. No.: WO02/072970

PCT Pub. Date: Sep. 19, 2002

(65) Prior Publication Data

US 2004/0134150 A1 Jul. 15, 2004

(30) Foreign Application Priority Data

| | | |
|---|---|---|
| Mar. 10, 2001 | (GB) | 0105991.4 |
| May 3, 2001 | (GB) | 0110820.8 |
| Dec. 14, 2001 | (GB) | 0129904.9 |

(51) Int. Cl.

| | |
|---|---|
| ***E04B 5/02*** | (2006.01) |
| ***E04B 5/18*** | (2006.01) |
| ***E04B 5/21*** | (2006.01) |
| ***E04B 5/46*** | (2006.01) |

(52) U.S. Cl. ..... 52/263; 52/506.04; 52/506.06; 52/506.03; 52/387

(58) Field of Classification Search ..... 52/204.6, 52/204.5, 263, 506.06, 506.01, 204.1, 506.03, 52/506.04, 507, 384–385, 387, 390, 392; 65/60.5, 104, 116, 114; 428/45–46, 210, 428/441

See application file for complete search history.

(56) References Cited

U.S. PATENT DOCUMENTS 2,403,369 A * 7/1946 Huber, Jr. ..... 52/307
3,560,316 A * 2/1971 Gill ..... 428/174

(Continued)

FOREIGN PATENT DOCUMENTS

DE 299 11 069 12/2000

(Continued)

OTHER PUBLICATIONS

European Patent Application 0396075 A1, Innovative Building Products, Inc, in Ventor: Taylor, Publication Date: Nov. 7, 1990.*

(Continued)

*Primary Examiner*—Jeanette Chapman
(74) *Attorney, Agent, or Firm*—Banner & Witcoff, Ltd.

(57) ABSTRACT

A fire rated glass flooring system comprising a first layer of glass which is a structural glass and a second layer of glass which is a fire rated glass, together with a structural frame supporting the flooring system, wherein the two layers of glass are positioned one above the other and are separated by at least one load transferring means. The flooring system is more aesthetic than conventional frames as the user of a load transferring means allows the first and second layers of glass to be brought closer together and hence the structural frame supporting the system is less visible through the system.

35 Claims, 7 Drawing Sheets

U.S. PATENT DOCUMENTS

| | | | | |
|---|---|---|---|---|
| 4,586,299 | A * | 5/1986 | Bayer | 52/79.7 |
| 4,638,613 | A * | 1/1987 | Tonsmann | 52/235 |
| 4,834,829 | A * | 5/1989 | Ash et al. | 156/382 |
| 4,999,964 | A * | 3/1991 | Taylor | 52/477 |
| 5,027,567 | A * | 7/1991 | Roberts | 52/57 |
| 5,216,855 | A * | 6/1993 | Richter et al. | 52/200 |
| 5,496,621 | A * | 3/1996 | Makita et al. | 428/216 |
| 5,715,636 | A * | 2/1998 | Taylor | 52/308 |
| 5,910,620 | A * | 6/1999 | O'Keeffe et al. | 65/60.5 |
| 6,105,319 | A * | 8/2000 | Brunt | 52/204.593 |
| 6,413,618 | B1 * | 7/2002 | Parker et al. | 428/195.1 |
| 6,446,404 | B1 * | 9/2002 | Bassin | 52/385 |
| 2004/0053057 | A1 * | 3/2004 | Hashibe et al. | 428/426 |

FOREIGN PATENT DOCUMENTS

| | | |
|---|---|---|
| EP | 0 319 695 | 6/1989 |
| FR | 2 723 123 | 2/1996 |
| GB | 2 289 076 | 11/1995 |

OTHER PUBLICATIONS

German Publication DE 32 34 348 A1, Inventor: Schuller, Mar. 22, 1984.*
English abstract of DE 299 11 069.
English abstract of EP 0 319 695.
English abstract of FR 2 723 123.

* cited by examiner

FIRE RATED GLASS FLOORING

This application is a National Stage application of co-pending PCT application PCT/GB02/01113 filed Mar. 11, 2002, which was published in English under PCT Article 21(2) on Sep. 19, 2002, which claims the benefit of GB application no. 0105991.4 filed Mar. 10, 2001; GB application no. 0110820.8 filed May 3, 2001 and GB application no. 0129904.9 filed Dec. 14, 2001. These applications are incorporated herein by reference in their entireties.

The present invention relates to fire rated glass flooring.

There are two principal fire rated glass flooring systems available at the present time. The first system is a double layer system comprising a fire rated glass and a structural glass, wherein the fire rated glass is supported by a first structure positioned at the bottom of a deep steel beam. The top of the beam supports the structural glass, which can be walked upon. The beam can be "I" section, box section or can be made up of two "T" section beams bolted or welded together.

This double layer system is expensive and its fire insulation capacity is limited to 30 minutes. Furthermore the system is aesthetically unappealing. The need to distance the two layers of glass by the depth of the beam means that when walking on the floor it is possible to see the beam and the first support structures through the structural glass. Furthermore the depth of the beam obscures the view through the glass floor to a large extent if a person walking on the floor looks through the floor at an angle rather than straight down.

The second system is a single layer system wherein the glass used is a multi laminate glass. The single layer system is limited to 30 minutes fire insulation and 30 minutes integrity. If the top sheet of the laminate is broken in use, the whole sheet needs to be replaced. Laminate glass is expensive.

Accordingly, there remains the need for a highly insulating, tough and aesthetic fire rated glass flooring.

Accordingly the present invention provides a fire rated glass flooring system comprising a first layer of glass and a second layer of glass, the two layers being positioned one above the other and separated by at least one load transferring means together with a structural frame supporting the flooring system, wherein the first layer of glass is a structural glass and the second layer of glass is a fire rated glass.

The use of the load transferring means allows the first and second layers of glass to be brought closer together. The load applied to the first layer bypasses the second layer and is transferred directly to the structural frame, allowing the structural frame to support the second layer and bear the load applied to the first layer. In the prior art double layer system a load transferring means was not included and therefore one portion of the structural frame bore the load from the first layer of glass and a separate portion of the structural frame supported the second layer of glass.

Preferably the first and second layers of glass are spaced less than 50 mm apart, more preferably less than 40 mm apart and most preferably 30 mm, 28 mm, 20 mm, 13.5 mm or 10 mm apart. The spacing is measured from the upper surface of the second layer to the lower surface of the first layer.

As the first and second layers of glass are brought closer together the structural frame is less visible through the glass flooring system of the present invention than in the existing systems, giving a more aesthetic flooring system. Furthermore as the first and second layers of glass are separated by at least one load transferring means rather than a deep beam the view through the floor is not obscured to such an extent when a person walking on the floor looks through it at an angle rather than straight down.

Preferably the first layer (which comprises structural glass) is positioned above the second layer (which comprises fire rated glass). The first and second layers are parallel to each other. The provision of the structural glass layer above the fire rated glass layer is so that in use the structural, load bearing glass layer is on top to bear the load applied thereto and the fire rated glass layer is below to delay the spread of fire.

A suitable type of structural glass is multi-laminated glass sheet made up of layers of float glass, heat strengthened glass and fully toughened glass bonded together using poly vinyl butyril or a resin. A particularly suitable glass of this type is Eckelt LITEFLOOR 33 mm triple laminate glass bonded together with poly vinyl butyril.

Particularly suitable fire rated glass includes sgg CONTRAFLAM®-N2 39 mm thick, sgg CONTRAFLAM® LITE 17 mm thick and sgg CONTRAFLAM® EI30 21 mm thick and 17 mm thick, although other fire rated glasses can be used depending on their fire rating properties.

The first and second layers preferably each comprise a number of co-extensive sheets of glass. The structural frame preferably comprises a number of beams and cross members positioned to support the sheets of glass forming the first and second layers.

In a first embodiment of the present invention the or each load transferring means preferably comprises a first portion for bearing the load applied to the first layer of glass and a second portion for transmitting the load applied to the first layer of glass to the structural frame.

The first portion in use is preferably horizontal and extends parallel to and between the first and second layers of glass. The second portion in use is preferably vertical and extends upwardly from the structural frame. The first portion is preferably perpendicular to and is in load transferring contact with the second portion. Most preferably the first portion is received in a corresponding slot in the second portion. The slot is preferably vertical and elongated to allow for adjustment of the height of the first portion.

The first portion of the load transferring means is preferably a portion of a glazing bar, most preferably a 30 mm×20 mm mild steel (MS) bar. The load transferring means may be made of other suitable materials, for example aluminium or of different dimensions or cross sections, for example box section, depending on the situation.

The second portion of the load transferring means is preferably one or a number of metal strips extending upwardly from the structural frame along the length thereof, most preferably a single steel strip having a height of 60-70 mm. The strip is preferably welded to the structural frame.

The first portion of the load transferring means is preferably insulated from the first and second layers of glass by appropriate materials.

The second layer of glass is preferably supported directly by the structural frame. An insulating material is preferably provided between the second layer of glass and the structural frame.

In a second embodiment of the present invention the or each load transferring means is preferably located on the structural frame and is of size and shape such that the first layer of glass is supported by the or each load transferring means.

In a first aspect of the second embodiment, the second layer of glass is supported by the frame leaving a small gap between the layers.

The or each load transferring means is preferably a box shape, more preferably a steel box. The load transferring means may be a solid steel box or a hollow steel box and is most preferably a 50 mm×25 mm solid steel box or a 50 mm×30 mm hollow steel box, depending on the type and thickness of fire rated glass used.

The first and second layers of glass are preferably insulated from the box by appropriate materials.

The second layer of glass is preferably supported directly by the frame. An insulating material is preferably provided between the second layer of glass and the beam.

A weighting means may be provided above the second layer of glass. Preferably the weighting means is above both the second layer of glass and the load transferring means. The weighting means preferably extends over the width of the load transferring means, more preferably over the width of the frame. It is preferred that the weighting means is attached to the load transferring means, preferably by means of a screw such as a self-tapping screw.

Preferably the weighting means is a plate, preferably a mild steel (MS) plate, most preferably a 3 mm thick mild steel plate.

In a second aspect of the second embodiment, the second layer of glass is suspended from the first layer of glass leaving a small gap between the layers.

The or each load transferring means is preferably a box shape, preferably a steel box, more preferably a hollow steel box and most preferably a 15 mm×35 mm rolled hollow steel box.

The first layer of glass is preferably insulated from the load transferring means by appropriate materials.

The second layer of glass is preferably attached to the first layer of glass by connecting means such as means known for connecting two layers of glass, for example by means known in double glazing systems. Preferably, the second layer of glass is attached to the first layer of glass by means of a bar such as a glazing bar and structural silicone.

It is preferred that the second layer of glass is insulated from the structural frame, preferably by fire rated material such as ceramic tape.

In a third embodiment of the present invention the or each load transferring means together with the structural frame form a C shape, with the first layer of glass being supported by the or each load transferring means and the second layer of glass being supported by the structural frame.

The lower horizontal section of the C shape is preferably formed by the structural frame. The upper horizontal section of the C shape is preferably formed by the load bearing means and in use is between the first and second layers of glass.

Preferably, the load transferring means comprises two sections: a first portion for bearing the load applied to the first layer of glass and a second portion for transmitting the load applied to the first layer of glass to the structural frame. The second portion is preferably integral with the structural frame. The first portion may be integral with the second portion, may be attached directly to the second portion or may be attached indirectly to the second portion via a connecting means. If the first portion is indirectly attached to the second portion, it should be adapted such that in use it cannot significantly rotate. For example, it may be of a size and shape such that it will not significantly rotate, or a component may be placed at a location below the first portion suitable to prevent any significant rotation.

The first portion is preferably a box shape, preferably a steel box, more preferably a hollow steel box and most preferably a 35 mm×15 mm hollow steel box.

The first portion is preferably attached to the second portion by a connecting means. The connecting means is preferably a plate, preferably a mild steel plate, and most preferably a 3 mm thick mild steel plate. The connecting means is attached to both the first portion and the second portion; preferably the connecting means is welded to the first portion and is attached to the second portion by means of a screw such as a self-tapping screw.

The first and second layers of glass are preferably insulated from the box by appropriate materials.

The second layer of glass is preferably supported directly by the frame. An insulating material is preferably provided between the second layer of glass and the beam.

The system of the third embodiment may suitably be used in combination with either the system of the first embodiment or the system of the second embodiment. For example, where there are a number of co-extensive sheets of glass in the first and second layers the system of the third invention may be used at the outer edges of the glass flooring, with the system of the second invention being used where the sheets of glass meet.

Preferably, the system of the third embodiment is used to form a square frame around the outer edges of each glass panel used. For example, where there are a number of co-extensive sheets of glass in the first and second layers a square frame comprising systems according to the third embodiment may be used around each glass panel, with a further frame supporting the complete system. Alternatively, where only one glass panel is involved, for example where an individual piece of glass is being inserted into a floor, a square frame comprising systems according to the third embodiment may be used around the glass panel.

The system of the second aspect of the second embodiment may be used in a similar manner to that described above for the third embodiment.

Throughout the specification, the terms box and box shape should be understood to refer to a substantially square or rectangular elongate member.

Embodiments of the present invention will now be described in more detail with reference to the figures, in which.

Figure 1:
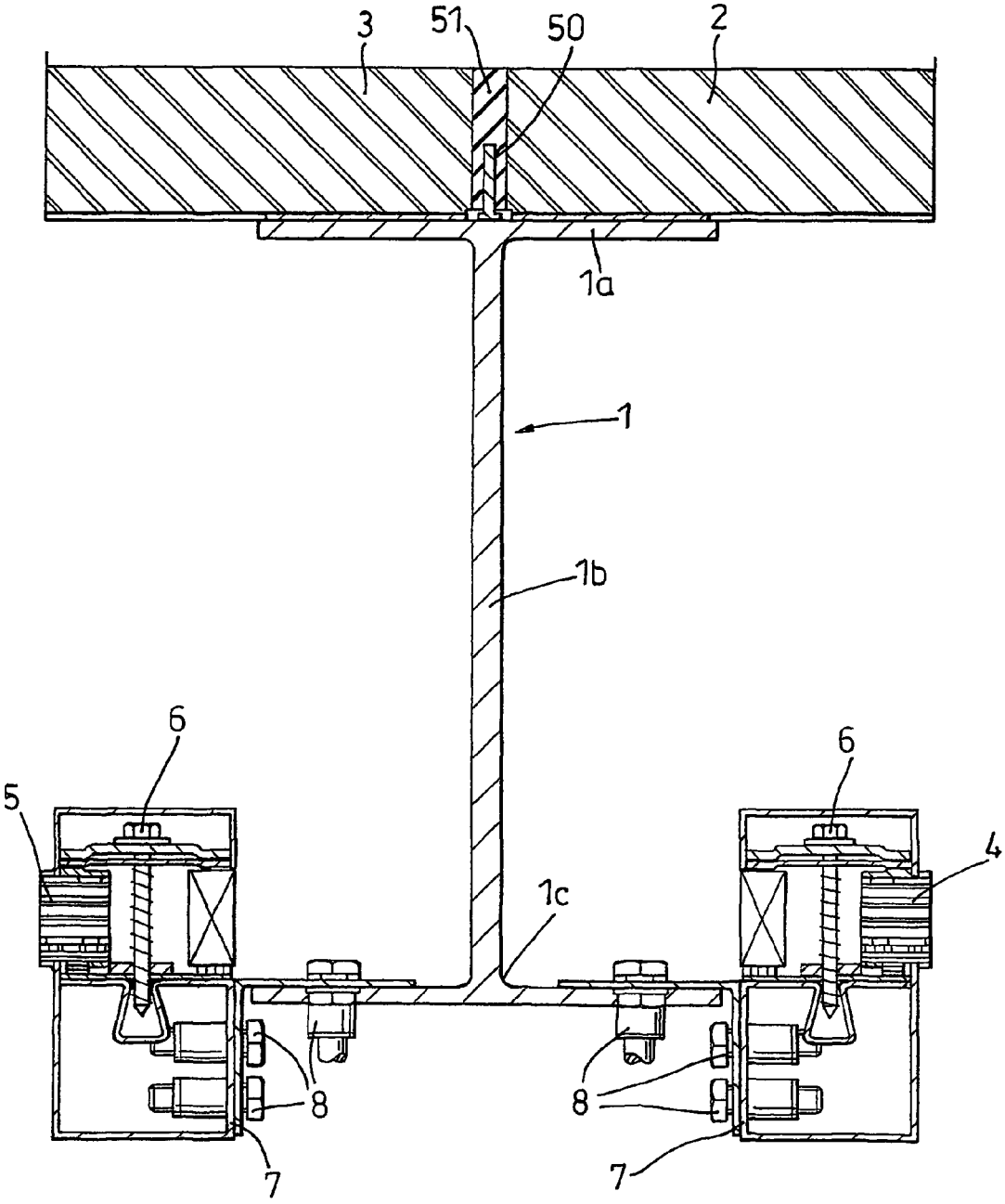
FIG. 1 shows a cross section through a first prior art fire rated glass-flooring system.

FIG. 1 shows a double layer prior art fire rated flooring-system. The system comprises a steel beam 1 of "I" section supporting on its upper end 1*a* two sheets 2, 3 of structural glass. The sheets of glass 2, 3 are supported on the upper end 1*a* of the beam 1 above the longitudinal portion 1*b* of the beam 1. The sheets of structural glass 2, 3 are spaced apart by means of a steel plate 50 and attached to opposite sides of the plate by means of a silicone sealant shown schematically at 51.

The lower end 1*c* of the beam 1 has attached to it and extending outwardly from both edges means to support fire rated glass sheets 4, 5. The fire rated glass sheets 4, 5 are held in position extending outwardly from, and parallel to, the lower end 1*c* of the beam 1 by means of clamps 6 mounted on mounting blocks 7 which are of square section to allow the clamp to be adjusted. The mounting blocks 7 are secured to the edges of the lower end 1*c* of the beam 1 by nuts and bolts 8.

The system described in relation to FIG. 1 was originally developed by EAG Firemaster using Pilkington PYROSTOP® glass.

Figure 2:
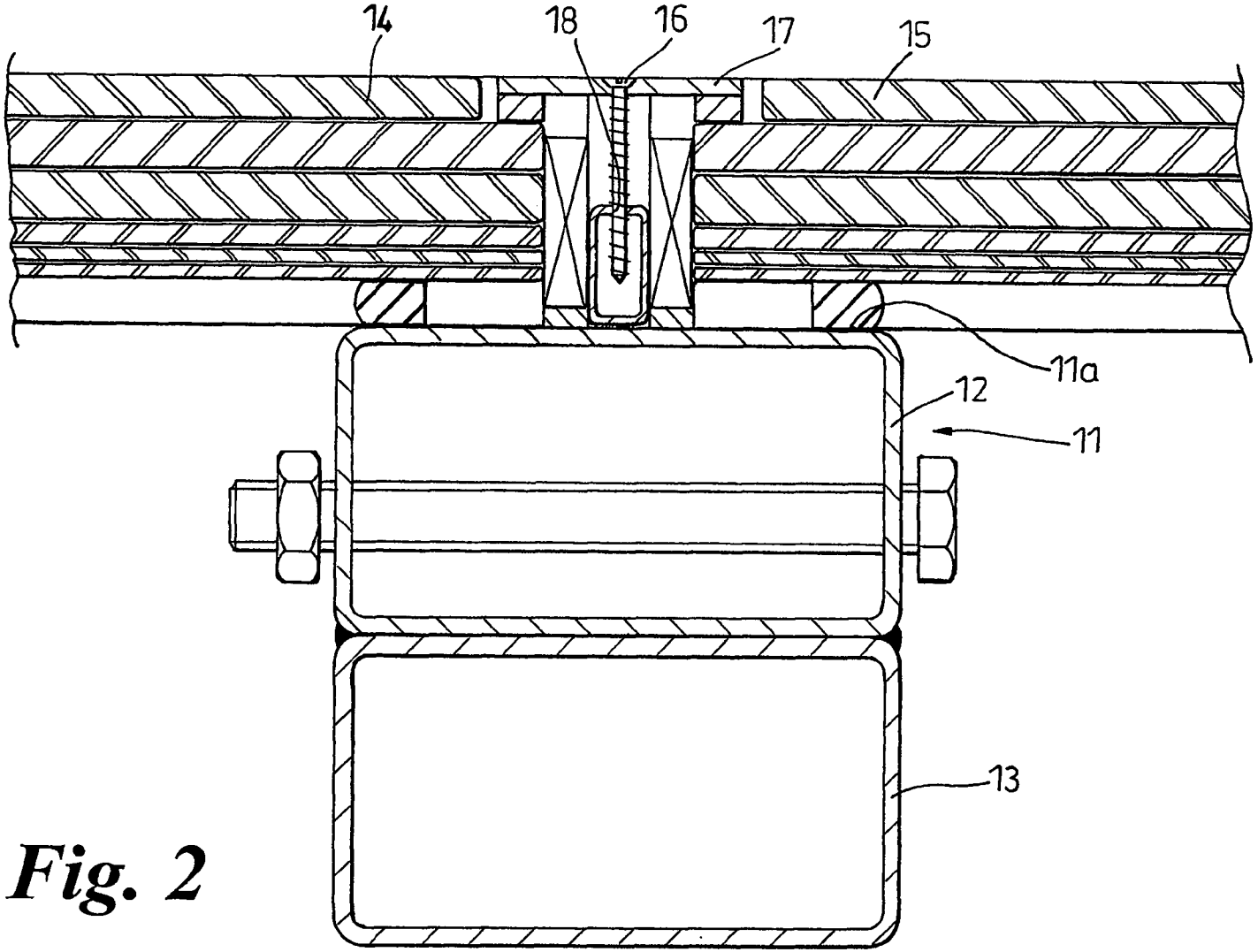
FIG. 2 shows a cross section through a second prior art fire rated glass-flooring system.

FIG. 2 shows a single layer prior art fire rated flooring system. The system comprises a steel beam 11, which comprises two beams 12, 13, each of rectangular section, positioned one on top of the other. Laminated glass sheets 14, 15 are supported by the top surface 11*a* of the beam 11 and extend outwardly from, and parallel to, the top surface 11*a*. The laminated sheets 14, 15 are spaced apart by means of a joining strip 17 and held in position by a clamping screw 16, which passes through the joining strip 17 and is received in a screw threaded aperture 18 in an extension of the upper surface 11*a* of the beam 11.

The system shown in FIG. 2 is available from the French company Preciver.

Figure 3:
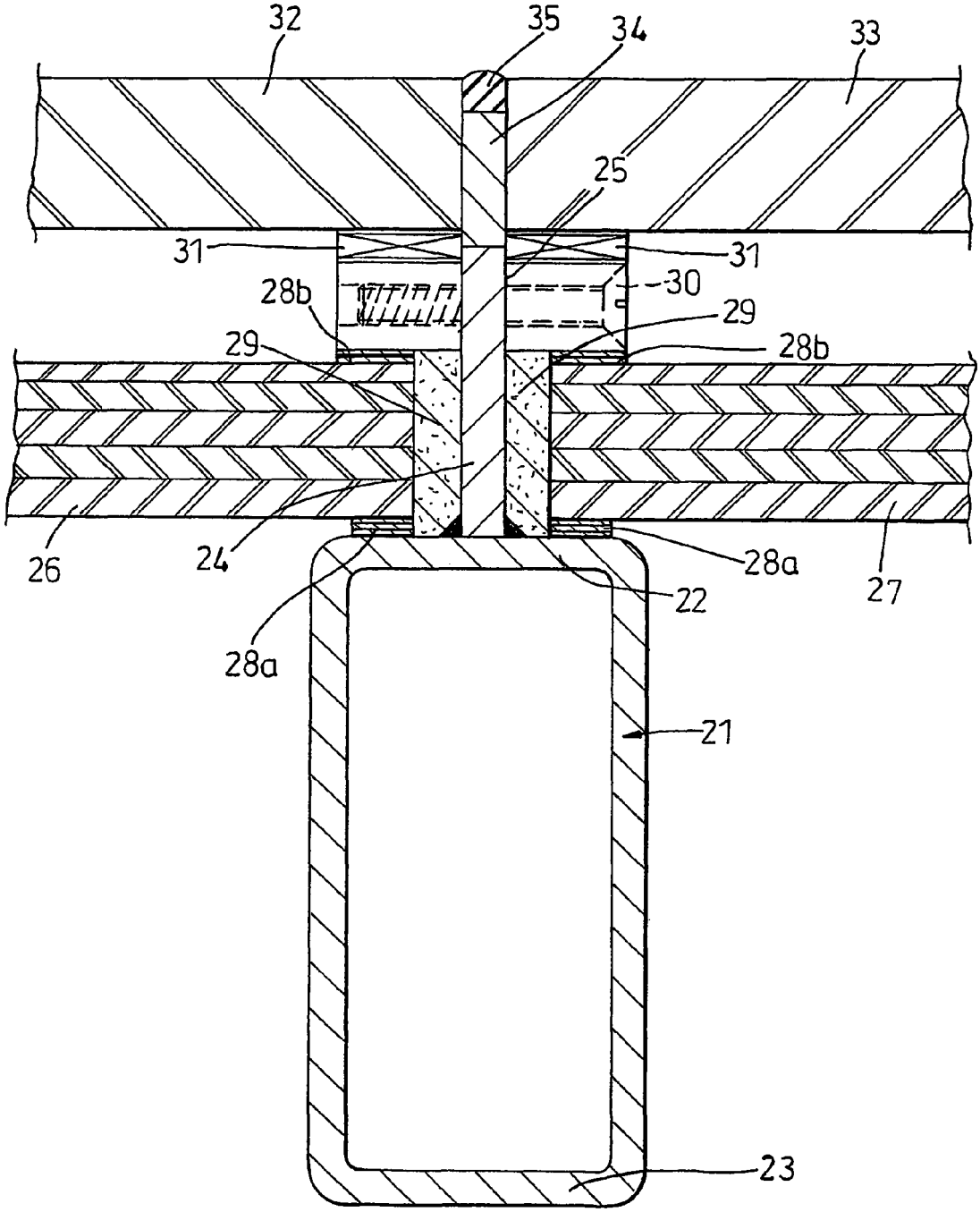
FIG. 3 shows a cross section through a first embodiment of a fire rated glass-flooring system of the present invention.

FIG. 3 shows a first embodiment of the double layer fire rated flooring system of the present invention. The system comprises a steel beam 21 of rectangular cross section. The beam 21 is 150 mm×100 mm×8 mm rolled hollow section (RHS) steel and cross members used to create a floor are 80 mm×80 mm×6.3 mm RHS steel. The beam and cross members are secured together by the use of rollers having screw threaded holes in either end to receive screws. The rollers pass through elongate slots provided in the beams and the cross members to secure them together in a manner that allows expansion and contraction in the event of a fire (not shown).

The beam is used with its shorter sides forming the top 22 and bottom 23 surfaces. A strip of 8 mm thick steel 24 is welded to the centre of the top surface 22 of the beam 21 extending along the length of the beam 21. The strip of steel has elongate slots 25 drilled in it along its length at spacing of 400 mm centre to centre.

Sheets of fire rated glass 26, 27 are positioned extending outwardly from, and are supported by, the beam 21 with one sheet of glass positioned on each side of the steel strip 24. A suitable fire rated glass is sgg-CONTRAFLAM®-90-N2 39 mm thick, which provides up to 90 minutes fire insulation and integrity when horizontal. The sheets of glass 26, 27 are isolated from the beam 21 by a fire rated filling material 28*a* such as KERAFIX ceramic fibre tape and from the steel strip 24 by a fire rated filling material 29 such as KERAFIX soft blanket and intumescent paper.

30 mm×20 mm mild steel glazing bars 30 pass through the slots 25 and are isolated from the fire rated glass sheets 26, 27 by filling material 28*b*, such as KERAFIX ceramic fibre tape, but hold the sheets 26, 27 in place. The glazing bars 30 are drilled and tapped to take countersunk studs (not shown) passing through the steel strip 24 at designated centres to take applied loading.

Silicone pads 31 are placed on top of the glazing bars 30 and structural glass sheets 32, 33 are placed on top of the silicone pads 31 parallel to the fire rated sheets 26, 27 and with the edges of the sheets 32, 33 being in line with the steel strip 24. Suitable structural glass is Eckelt LITEFLOOR 33 mm triple laminate glass bonded together with poly vinyl butyril. This glass can take loads in excess of 5.0 kN per metre square. The space between the sheets 32, 33 is filled with a solid silicone strip 34 and topped with a silicone sealant 35.

All exposed steelwork is painted with intumescent paint.

The sheets of fire rated glass are spaced apart from the sheets of structural glass by approximately 30 mm as the glazing bar has a thickness of 20 mm, the KERAFIX tape has a thickness of 4 mm and the silicone strip has a thickness of 6 mm.

Figure 4:
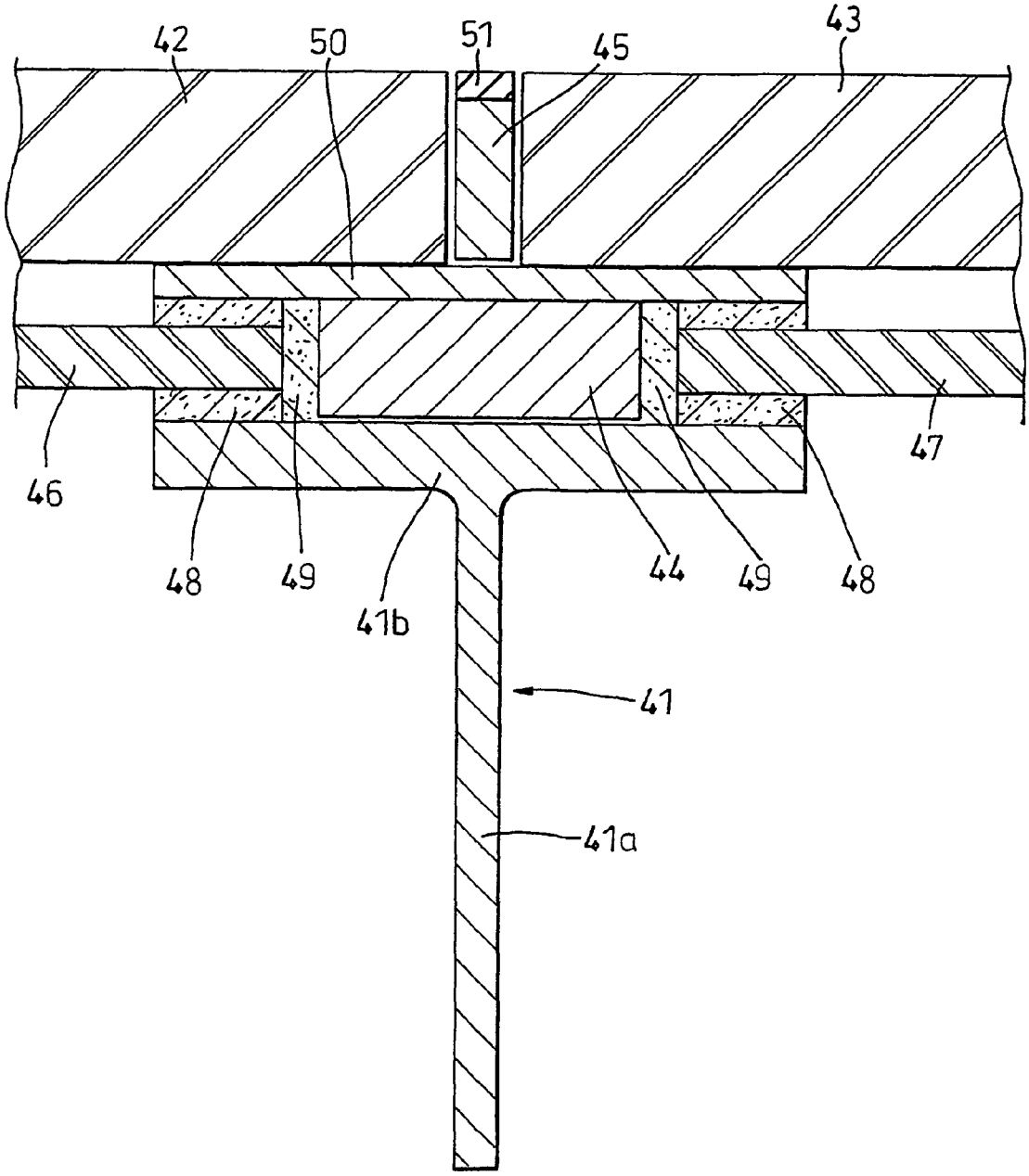
FIG. 4 shows a cross section through a first aspect of a second embodiment of a fire rated glass-flooring system of the present invention.

FIG. 4 shows a second embodiment of the present invention. The system comprises a steel beam 41 having a T shaped cross-section. The vertical section 41*a* of the beam 41 is 127 mm tall and 14 mm thick. The horizontal section 41*b* is 110 mm wide and 10 mm thick. The vertical section 41*a* is integral with the horizontal section 41*b*, the sections joining at the centre of the horizontal section 41*b*. There are cross members as those discussed in relation to FIG. 3.

A steel box 44 runs the length of the beam and is located in the centre of the horizontal section of the beam 41*b*. The box is of solid steel of dimensions 50 mm wide and 25 mm tall.

The sheets of fire rated glass 46, 47 are positioned extending outwardly from, and supported by, the beam 41 with one sheet of glass positioned on each side of the steel box 44. A suitable fire rated glass is sgg CONTRAFLAM® LITE 17 mm thick. Each sheet of fire rated glass 46, 47 is isolated from the beam by a fire rated filling material 48 such as KERAFIX ceramic fibre tape 4 mm thick. A strip of this tape is also applied to the top of the glass sheet. As the tape 48 is 4 mm thick, and as the steel box 44 is 25 mm tall and the fire rated glass 46, 47 is 17 mm thick, the glass with tape on both sides is the same height as the box, as can be seen in FIG. 4. The fire rated glass sheets 46, 47 are also isolated from the steel box 44 by insulating paper 49 such as KERAFIX bläh papier 43.

Silicone pads 50 of 6 mm thickness are placed on top of the box and extending to the width of the beam, resting on the filling material 48. The structural glass sheets 42, 43 are placed on top of the silicon pads 50 parallel to the fire rated glass sheets 46, 47. The edges of the sheets do not touch but are isolated from each other by a further silicon pad 45 topped with a silicon sealant 51. Suitable structural glass is Eckelt LITEFLOOR 33 mm triple laminate glass bonded together with poly vinyl butyril. This glass can take loads in excess of 5.0 kN per metre square.

Again, all exposed steelwork is painted with intumescent paint.

The sheets of fire rated glass are spaced apart from the sheets of structural glass by approximately 10 mm as the KERAFIX tape has a thickness of 4 mm and the silicon pad has a thickness of 6 mm.

Figure 5:
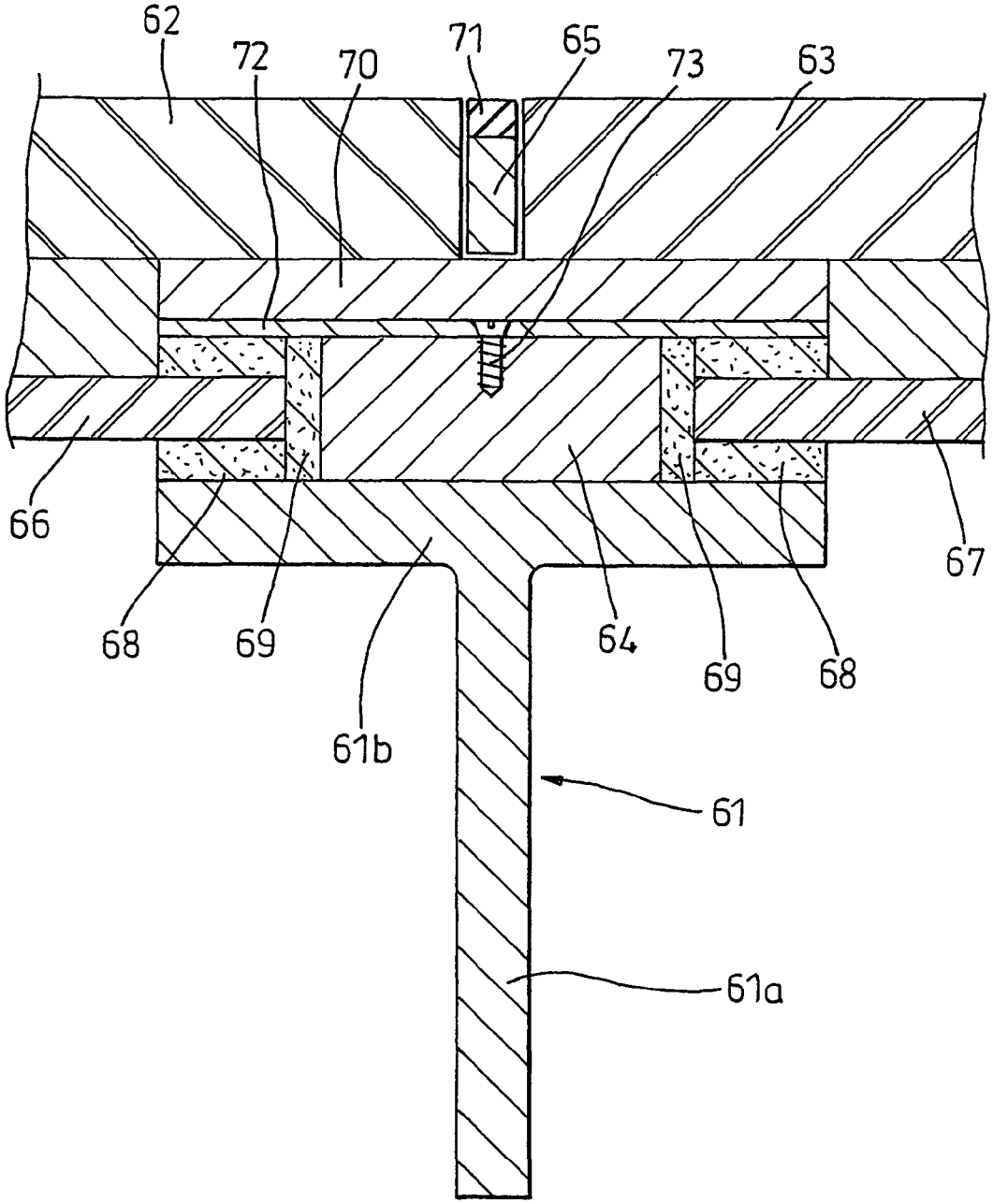
FIG. 5 shows a cross section through a modified form of the system of FIG. 4.

FIG. 5 shows a modified form of the second embodiment of the present invention. The system comprises a steel beam 61 having a T shaped cross-section. The vertical section 61*a* of the beam 61 is 127 mm tall and 14 mm thick. The horizontal section 61*b* is 110 mm wide and 10 mm thick. The vertical section 61*a* is integrated with the horizontal section 61*b*, the sections joining at the centre of the horizontal section 61*b*. There are cross members as those discussed in relation to FIG. 3.

A hollow steel box 64 runs the length of the beam and is located in the centre of the horizontal section of the beam 61*b*. The box is 50 mm wide and 30 mm tall.

The sheets of fire rated glass 66, 67 are positioned extending outwardly from, and supported by, the beam 61 with one sheet of glass positioned on each side of the hollow box 64. A suitable fire rated glass is sgg CONTRAFLAM® EI30, with a thickness of 21 mm. Each sheet of fire rated glass 66, 67 is isolated from the beam by a fire rated filling material 68 such as KERAFIX ceramic fibre tape 4.5 mm thick. A strip of this tape is also applied to the top of the glass sheet. As the filling material 68 is 4.5 mm thick, the hollow box 64 is 30 mm high and the fire rated glass 66, 67 is 21 mm thick, the glass with filling material on both sides is the same height as the box, as can be seen in FIG. 5. The fire rated glass sheets 66, 67 are also isolated from the hollow box 64 by insulating paper 69 such as KERAFIX bläh papier 43.

A mild steel plate 72 of thickness 3 mm is attached to the top of the box 64 by means of a self-tapping screw 73. The plate extends to the width of the beam, resting on the filling material 68. Silicone pads 70 of 6 mm thickness are placed on top of the plate, covering the width of the plate.

Structural glass sheets 62, 63 are placed on top of the silicon pads 70 parallel to the fire rated glass sheets 66, 67. The edges of the sheets do not touch but are isolated from each other by a further silicon pad 65 topped with a silicon sealant 71. Suitable structural glass is Eckelt LITEFLOOR 33 mm triple laminate glass bonded together with polyvinyl butyril. This glass can take loads in excess of 5.0 kN per metre square.

As in the previous embodiments, all exposed steelwork is painted with intumescent paint.

The sheets of fire rated glass are spaced apart from the sheets of structural glass by approximately 13.5 mm as the KERAFIX tape has a thickness of 4.5 mm, the mild steel plate has a thickness of 3 mm and the silicon pad has a thickness of 6 mm.

Figure 6:
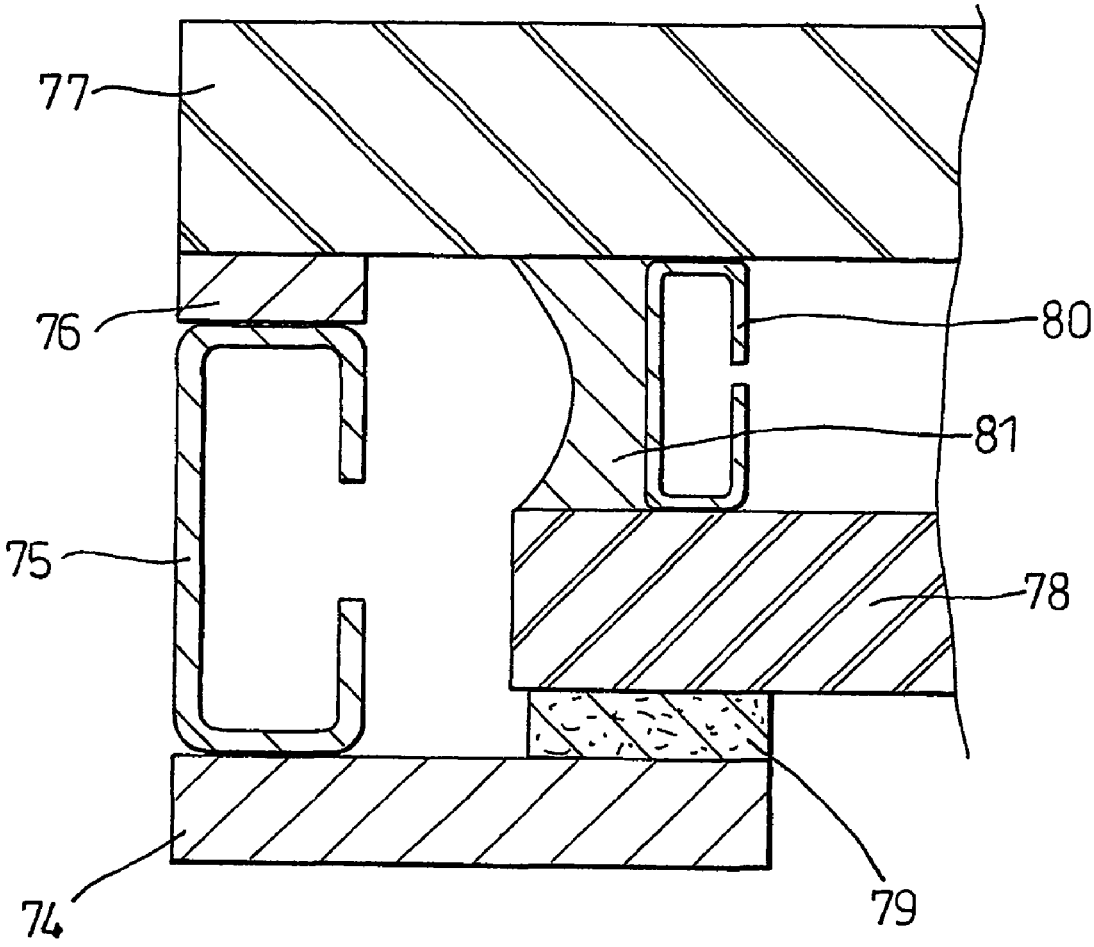
FIG. 6 shows a cross section through a second aspect of a second embodiment of a fire rated glass-flooring system of the present invention.

FIG. 6 shows a variant of the second embodiment of the present invention. The system comprises a mild steel beam 74, which is 45 mm wide and 6 mm thick. There are cross members as those discussed in relation to FIG. 3.

A hollow box 75 is attached to the beam 74 and runs from one edge of the beam 74 towards the centre of the beam 74. The box 75 is of rolled hollow steel and has a width of 15 mm, a depth of 45 mm and a height of 35 mm. The box 75 is preferably welded to the beam 74 using intermittent welds.

Silicone pads 76 of 6 mm thickness are placed on top of the box 75. A structural glass sheet 77 is placed on top of the silicon pads 76, extending outwardly from and supported by the box 75 and parallel to the beam 74. Suitable structural glass is Eckelt LITEFLOOR 24 mm triple laminate glass bonded together with polyvinyl butyril.

A sheet of fire rated glass 78 is attached to and supported from the structural glass 77. The fire rated glass 78 runs between and parallel to the structural glass 77 and the beam 74, from a point approximately half way along the beam 74 such that there is a gap between the box 75 and the fire rated glass sheet 78 of 8 mm. A suitable fire rated glass is sgg CONTRAFLAM® EI30 17 mm thick. The fire rated glass sheet 78 is attached to the structural glass sheet 77 by means of a glazing bar 80 and structural silicone 81. The glazing bar 80 is of dimensions 20 mm high and 7 mm wide.

The fire rated glass sheet 78 is isolated from the beam 74 by a fire rated filling material 79 such as KERAFIX ceramic fibre tape 4 mm thick. As the tape is 4 mm thick, the fire rated glass 78 is 17 mm thick and the glazing bar 80 is 20 mm high, and the box 75 is 35 mm tall and the silicone pad 76 6 mm thick, the glass with tape beneath and glazing bar above is the same height as the box with the silicone pad above, as can be seen in FIG. 6.

Again, all exposed steelwork is painted with intumescent paint.

The sheet of fire rated glass 78 is spaced apart from the sheet of structural glass 77 by approximately 20 mm as the height of the glazing bar 80 suspending the fire rated glass 78 from the structural glass 77 is 20 mm.

Figure 7:
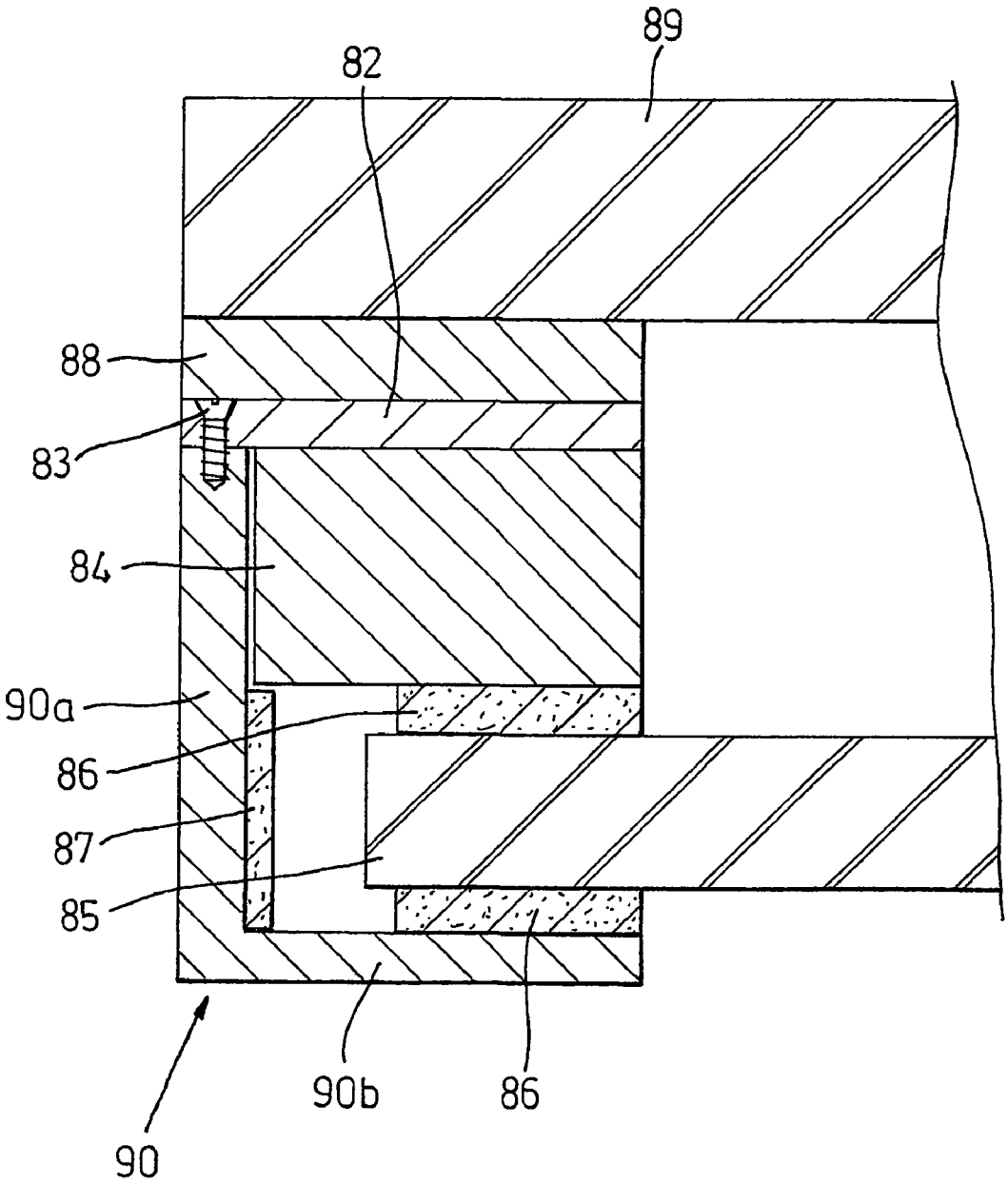
FIG. 7 shows a cross section through a third embodiment of a fire rated glass flooring system of the present invention.

FIG. 7 shows a third embodiment of the present invention. The system comprises a steel beam 90 having an L shaped cross section. The vertical section 90*a* of the beam is 50 mm tall and 6 mm thick. The horizontal section 90*b* of the beam is 41 mm wide and 6 mm thick. The vertical section 90*a* is integrated with the horizontal section 90*b*. The horizontal section 90*b* of the beam is provided with cross members as those discussed in relation to FIG. 3.

A mild steel plate 82 of thickness 3 mm extends outwardly from the top of the vertical section 90*a* of the beam, substantially parallel to the horizontal section 90*b* of the beam. The mild steel plate extends to the width of the horizontal section 90*b* of the beam and is attached to the top of the vertical section of the beam by means of a self-tapping screw 83.

A rolled steel hollow box 84 of width 35 mm and height 15 mm is stitch welded to the bottom face of the mild steel plate 82. The box is adjacent to the vertical beam 90*a* and extends to the outer edge of the plate 82.

The sheet of fire rated glass 85 is positioned between the horizontal beam 90*b* and the hollow box 84, extending outwardly from, and supported by, the horizontal beam 90*b*. A suitable fire rated glass is sgg CONTRAFLAM® EI30, with a thickness of 21 mm. The fire rated glass 85 is isolated from the horizontal beam 90*b* by a fire rated filling material 86 such as KERAFIX ceramic fibre tape 4 mm thick. A strip of this tape is also applied to the top of the glass sheet to separate it from the hollow box 84. The fire rated glass sheet 85 is also isolated from the vertical beam 90*a* by insulating paper 87 such as KERAFIX bläh papier 43.

Silicone pads 88 of 6 mm thickness are placed on top of the mild steel plate, extending to the width of the plate. The structural glass sheet 89 is placed on top of the silicon pads 88 parallel to the fire rated glass sheet 85. Suitable structural glass is Eckelt LITEFLOOR 33 mm triple laminate glass bonded together with polyvinyl butyril. This glass can take loads in excess of 5.0 kN per metre square.

As in the previous embodiments, all exposed steelwork is painted with intumescent paint.

The sheet of fire rated glass is spaced apart from the sheet of structural glass by approximately 28 mm as the KERAFIX tape has a thickness of 4 mm, the hollow box has a height of 15 mm, the mild steel plate has a thickness of 3 mm and the silicon pad has a thickness of 6 mm.

The invention claimed is:

1. A fire rated glass flooring system comprising:

a first layer of glass which comprises a structural glass;

a second layer of glass which comprises a fire rated glass, wherein the first layer of glass is positioned above the second layer of glass;

one or more load transferring means; and a structural frame comprising a plurality of beams and a plurality of cross members interconnecting the beams, wherein the structural frame supports the first and second layers of glass and the one or more load transferring means;

characterized in that the two layers of glass are separated by one or more of the load transferring means, and at least one of the load transferring means comprises a horizontal portion supporting the first layer of glass above and a vertical portion transferring load from the first layer of glass above directly to the structural frame below, bypassing the second layer of glass.

2. A fire rated glass flooring system as claimed in claim 1 wherein the distance from the upper surface of the second layer of glass to the lower surface of the first layer of glass is less than 50 mm.

3. A fire rated glass flooring system as claimed in claim 1 wherein the structural glass is multi-laminated glass sheet made up of layers of float glass, heat strengthened glass and fully toughened glass bonded together using poly vinyl butyril or a resin.

4. A fire rated glass flooring system as claimed in claim 1 wherein the fire rated glass is selected from sgg CONTRAFLAM®-N2 39 mm thick, sgg CONTRAFLAM® LITE 17 mm thick and sgg CONTRAFLAM® EI30 21 mm or 17 mm thick.

5. A fire rated glass flooring system as claimed in claim 1 wherein the second layer of glass is supported directly by the structural frame.

6. A fire rated glass flooring system as claimed in claim 1 wherein the horizontal portion of the load transferring means in use extends parallel to and between the first and second layers of glass.

7. A fire rated glass flooring system as claimed in claim 1 wherein the vertical portion of the load transferring means in use extends upwardly from the structural frame.

8. A fire rated glass flooring system as claimed in claim 1 wherein the horizontal portion of the load transferring means is perpendicular to and is in load transferring contact with the vertical portion of the load transferring means.

9. A fire rated glass flooring system as claimed in claim 1 wherein the horizontal portion of the load transferring means is received in a corresponding slot in the vertical portion of the load transferring means.

10. A fire rated glass flooring system as claimed in claim 9 wherein the slot is vertical and elongate to allow for adjustment of the height of the first portion.

11. A fire rated glass flooring system as claimed in claim 1 wherein the horizontal portion of the load transferring means is a portion of a glazing bar.

12. A fire rated glass flooring system as claimed in any one of claims 1 to 11 wherein the vertical portion of the load transferring means is one or more metal strips extending upwardly from the structural frame along the length thereof.

13. A fire rated glass flooring system as claimed in claim 1 wherein the or each load transferring means is located on the structural frame and is of size and shape such that the first layer of glass is supported by the or each load transferring means.

14. A fire rated glass flooring system as claimed in claim 13 wherein the or each load transferring means is a box shape.

15. A fire rated glass flooring system as claimed in claim 13 wherein the or each load transferring means is selected from a solid steel box and a hollow steel box.

16. A fire rated glass flooring system as claimed in claim 13 wherein the second layer of glass is supported by the structural frame, leaving a small gap between the first and second layers of glass.

17. A fire rated glass flooring system as claimed in claim 16 wherein a weighting means is provided above the second layer of glass.

18. A fire rated glass flooring system as claimed in claim 17 wherein the weighting means is above both the second layer of glass and the load transferring means.

19. A fire rated glass flooring system as claimed in claim 17 wherein the weighting means extends over the width of the load transferring means.

20. A fire rated glass flooring system as claimed in claim 17 wherein the weighting means is a plate.

21. A fire rated glass flooring system as claimed in claim 13 wherein the second layer of glass is suspended from the first layer of glass such that there is a small gap between the first and second layers of glass.

22. A fire rated glass flooring system as claimed in claim 21 wherein the or each load transferring means is a hollow steel box.

23. A fire rated glass flooring system as claimed in claim 21 wherein the second layer of glass is suspended from the first layer of glass by means of a glazing bar and structural silicone.

24. A fire rated glass flooring system comprising a first layer of glass which is a structural glass and a second layer of glass which is a fire rated glass, together with a structural frame supporting the flooring system, wherein the two layers of glass are positioned one above the other, characterized in that the two layers of glass are separated by one or more load transferring means and the load transferring means transfers load applied to the first layer of glass directly to the structural frame, bypassing the second layer of glass, and wherein the or each load transferring means together with the structural frame form a C shape having an upper horizontal section, a lower horizontal section and a connecting vertical section, with the first layer of glass being supported by the or each load transferring means and the second layer of glass being supported by the structural frame.

25. A fire rated glass flooring system as claimed in claim 24 wherein the load transferring means comprises a first portion for bearing the load applied to the first layer of glass and a second portion for transmitting the load applied to the first layer of glass to the structural frame.

26. A fire rated glass flooring system as claimed in claim 24 wherein the lower horizontal section of the C shape is formed by the structural frame, the upper horizontal section of the C shape is formed by some or all of the load transferring means and in use the upper horizontal section of the C shape is between the first and second layers of glass.

27. A fire rated glass flooring system as claimed in claim 25 wherein the second portion is integral with the structural frame.

28. A fire rated glass flooring system as claimed in claim 25 wherein the first portion is integral with the second portion, is attached directly to the second portion or is attached indirectly to the second portion via a connecting means.

29. A fire rated glass flooring system as claimed in claim 28 wherein the first portion is attached to the second portion by a connecting means.

30. A fire rated glass flooring system as claimed in claim 29 wherein the connecting means is a plate.

31. A fire rated glass flooring system as claimed in claim 25 wherein the first portion is a box shape.

32. A fire rated glass flooring system comprising:

a first layer of glass which comprises structural glass, a second layer of glass which comprises fire rated glass, one or more load transferring means, and a structural frame supporting the flooring system comprising a plurality of beams and a plurality of cross members interconnecting the beams;

wherein the first layer which comprises structural glass is positioned above the second layer which comprises fire rated glass and the distance from the upper surface of the second layer of glass to the lower surface of the first layer of glass is less than 50 mm;

characterized in that the two layers of glass are separated by one or more of the load transferring means, and the or each load transferring means:

comprises a box shape selected from a solid steel box and a hollow steel box, is located on the structural frame, and is of size and shape such that the first layer of glass is supported by the or each load transferring means, and wherein the second layer of glass is supported by the structural frame leaving a small gap between the first and second layers of glass.

33. A fire rated glass flooring system comprising:

a first layer of glass which comprises a structural glass, a second layer of glass which comprises a fire rated glass, one or more load transferring means, and a structural frame supporting the flooring system comprising a plurality of beams and a plurality of cross members interconnecting the beams;

wherein the first layer which comprises structural glass is positioned above the second layer which comprises fire rated glass, the distance from the upper surface of the second layer of glass to the lower surface of the first layer of glass is less than 50 mm, and the second layer of glass is supported by the structural frame, leaving a small gap between the first and second layers of glass, characterized in that the two layers of glass are separated by one or more of the load transferring means, and at least one of the load transferring means comprises a horizontal portion supporting the first layer of glass above and a vertical portion transferring load from the first layer of glass above directly to the structural frame below, bypassing the second layer of glass;

wherein the or each load transferring means is located on the structural frame, is selected from a solid steel box and a hollow steel box, and is of size and shape such that the first layer of glass is supported by the or each load transferring means, and wherein a weighting means which is a plate is provided above the second layer of glass and extends over the width of at least one of the load transferring means.

34. A fire rated glass flooring system comprising:

a first layer of glass which is a structural glass, a second layer of glass which is a fire rated glass, and one or more load transferring means, together with a structural frame supporting the flooring system comprising a plurality of beams and a plurality of cross members interconnecting the beams;

wherein the first layer which comprises structural glass is positioned above the second layer which comprises fire rated glass, the second layer of glass is suspended from the first layer of glass by means of a glazing bar and structural silicone, leaving a small gap between the first and second layers of glass, and the distance from the upper surface of the second layer of glass to the lower surface of the first layer of glass is less than 50 mm, characterized in that:

the two layers of glass are separated by one or more of the load transferring means, and at least one of the load transferring means comprises a horizontal portion supporting the first layer of glass above, and a vertical portion transferring load from the first layer of glass above directly to the structural frame below, bypassing the second layer of glass;

wherein the or each load transferring means is a hollow steel box located on the structural frame and is of size and shape such that the first layer of glass is supported by the or each load transferring means.

35. A fire rated glass flooring system comprising a first layer of glass which is a structural glass and a second layer of glass which is a fire rated glass, together with a structural frame supporting the flooring system, wherein the first layer which comprises structural glass is positioned above the second layer which comprises fire rated glass, the second layer of glass is suspended from the first layer of glass by means of a glazing bar and structural silicone such that there is a small gap between the first and second layers of glass, and the distance from the upper surface of the second layer of glass to the lower surface of the first layer of glass is less than 50 mm, characterized in that the two layers of glass are separated by one or more load transferring means, wherein the or each load transferring means is a hollow steel box and together with the structural frame forms a C shape having an upper horizontal section, a lower horizontal section and a connecting vertical section, with the first layer of glass being supported by the or each load transferring means and the second layer of glass being supported by the structural frame.

* * * * *

UNITED STATES PATENT AND TRADEMARK OFFICE

CERTIFICATE OF CORRECTION

PATENT NO. : 7,694,475 B2
APPLICATION NO. : 10/471203
DATED : April 13, 2010
INVENTOR(S) : Michael Scott Rae It is certified that error appears in the above-identified patent and that said Letters Patent is hereby corrected as shown below:

Title Page, Item (73) Assignee:

Please replace Wilde Contracts Limited, Oldham (GB) with Ely Holdings Limited, Oldham (GB)

Signed and Sealed this

Twenty-eighth Day of September, 2010

David J. Kappos

David J. Kappos
*Director of the United States Patent and Trademark Office*